US006254085B1

(12) United States Patent
Kang

(10) Patent No.: US 6,254,085 B1
(45) Date of Patent: Jul. 3, 2001

(54) PAPER FEEDING APPARATUS FOR PRINTING DEVICE

(75) Inventor: Il-kwon Kang, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/420,782

(22) Filed: Oct. 19, 1999

(30) Foreign Application Priority Data

Oct. 21, 1998 (KR) ..... 98-44193

(51) Int. Cl.[7] ..... B65H 7/02
(52) U.S. Cl. ..... 271/171
(58) Field of Search ..... 271/171; 399/393; 400/629

(56) References Cited

U.S. PATENT DOCUMENTS 5,647,585 * 7/1997 Cheong ..... 271/171
5,655,764 * 8/1997 Ota et al. ..... 271/171
6,073,925 * 6/2000 Sato ..... 271/171

FOREIGN PATENT DOCUMENTS 4-16427 1/1992 (JP) ..... B65H/1/04
6-32489 2/1994 (JP) ..... B65H/7/02
6-32466 * 6/1994 (JP) ..... B65H/1/24

* cited by examiner

*Primary Examiner*—Christopher P. Ellis
*Assistant Examiner*—Kenneth W Bower
(74) *Attorney, Agent, or Firm*—Sughrue, Mion, Zinn, Macpeak & Seas, PLLC

(57) ABSTRACT

A paper feeding apparatus of a printing device is provided. The paper feeding apparatus includes a tray releasably combined to the main body of the printing device for receiving paper. A guide plate is movably installed in the tray according to the page size of the paper, and a link is pivotally installed centering around a hinge shaft provided in the tray, to one end of which the guide plate is connected, which pivots around the hinge shaft according to the movement of the guide plate. Also, a rack is slidably installed in the tray, connected to the other end of the link, which slides according to the pivot of the link. A driving plate which rotates is provided, which engages with the rack and in which a plurality of marks corresponding to the page size of the paper are formed, and a sensor is provided for sensing the marks and the page size of the paper.

3 Claims, 3 Drawing Sheets

PAPER FEEDING APPARATUS FOR PRINTING DEVICE

BACKGROUND OF THE INVENTION

1. Field of the Invention

The present invention relates to an apparatus for feeding paper to a printing device, and more particularly, to the paper feeding apparatus of a printing device having an improved structure, which senses the page size of provided paper.

2. Description of the Related Art

An apparatus for feeding paper to the inside of the main body of a printing device is provided in a printing device such as a printer or a photocopier. The paper feeding apparatus shown in FIG. 1, includes a tray 20 releasably combined to one side of the main body 10 of the printing device, for receiving a stack of paper. A guide plate 21 for supporting the end portion of the received pieces of paper is movably installed in the tray 20 according to the paper size standard of the paper to be used. For example, in order to use A3 size paper instead of A4 size paper, the guide plate 21 is moved to a position suitable for the standard of the A3 size paper and then the paper is loaded.

In the conventional paper feeding apparatus having the above structure, since it is not possible to know the page size of paper received in the tray 20 unless the tray 20 is pulled out and checked, it is possible to have a printing error due to a difference in the size of an image to be printed and the page size of the paper. Namely, if the A4 size paper is loaded in the tray 20 when an image is intended for A3 size paper, the user only realizes the error after the printing is completed. Therefore, in this case, the paper is wasted and half of the image which was not printed is printed on a predetermined part in the printing device, thus contaminating the printing device, thus requiring cleaning of the printing device in order to print a clear image on the paper.

SUMMARY OF THE INVENTION

To solve the above problem, it is an object of the present invention to provide a paper feeding apparatus of a printing device having an improved structure so that a user can confirm the page size of the paper received in a tray without pulling out the tray from the main frame of the printing device.

Accordingly, to achieve the above object, there is provided a paper feeding apparatus of a printing device comprising a tray releasably combined to the main body of the printing device for receiving paper, a guide plate movably installed in the tray according to the page size of the paper, and a page size sensing means for sensing the movement position of the guide plate and determining the page size of the paper received in the tray, wherein the page size sensing means comprises a link which is pivotally installed centering around a hinge shaft provided in the tray, to one end of which the guide plate is connected, and which pivots around the hinge shaft according to the movement of the guide plate, a rack slidably installed in the tray, connected to the other end of the link, and sliding according to the pivot of the link, a driving plate which rotates, engaged with the rack and in which a plurality of marks corresponding to the page size of the paper are formed, and a sensor for sensing the marks and the page size of the paper.

BRIEF DESCRIPTION OF THE DRAWING(S)

The above object and advantages of the present invention will become more apparent by describing in detail a preferred embodiment thereof with reference to the attached drawings in which.

DESCRIPTION OF THE PREFERRED EMBODIMENT(S)

Figure 1:
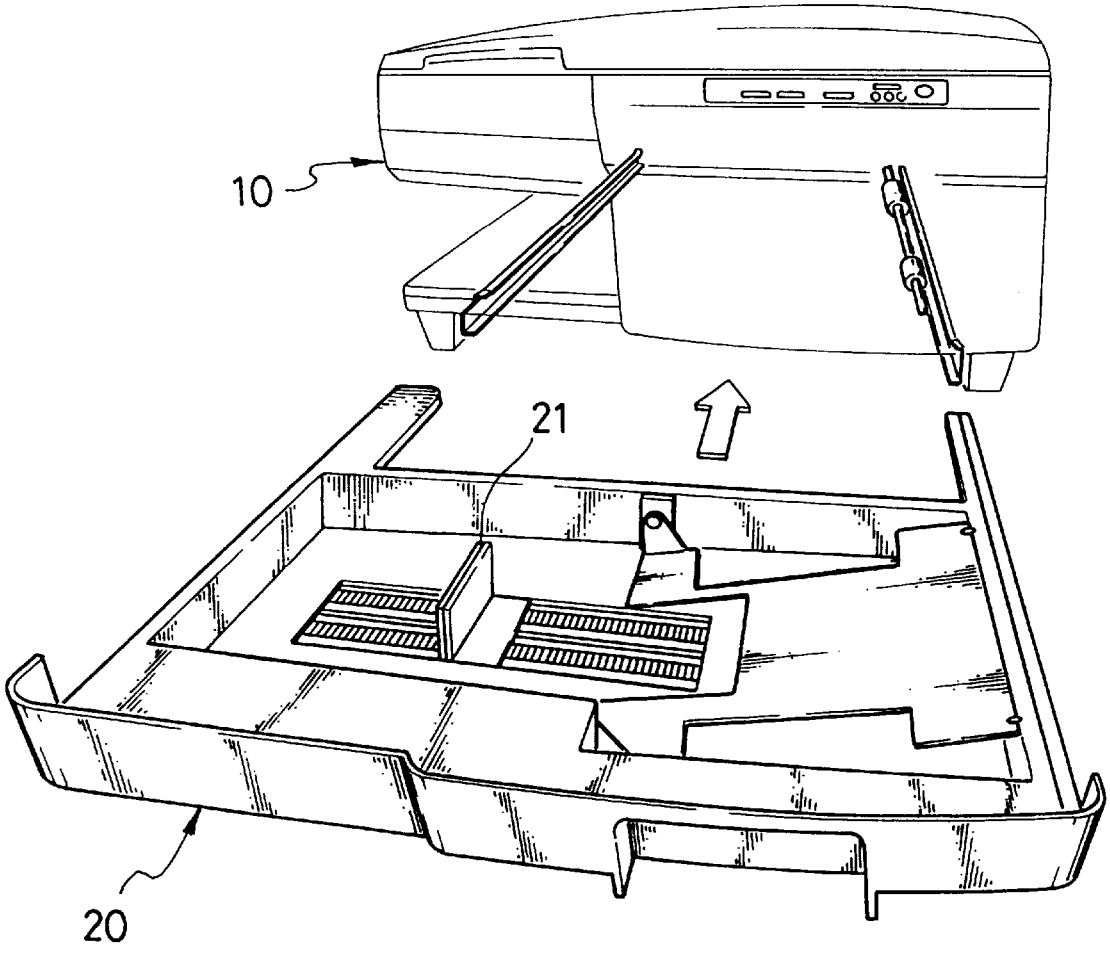
FIG. 1 (PRIOR ART)
FIG. 1 is a perspective view showing the paper feeding apparatus of a conventional printing apparatus.
Figure 2:
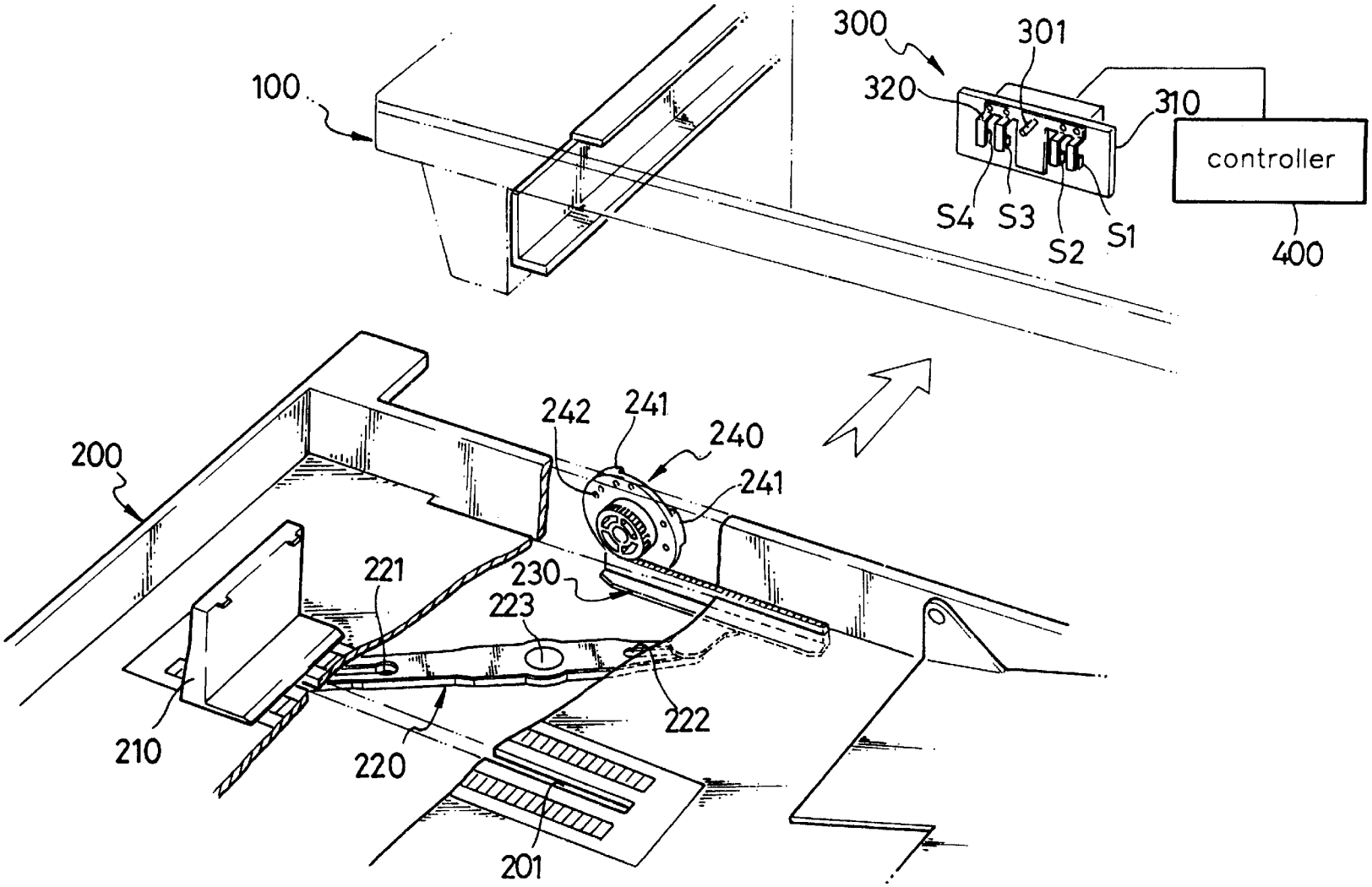
FIG. 2 is a perspective view showing the paper feeding apparatus of a printing device according to a preferred embodiment of the present invention.

FIG. 2 shows the paper feeding apparatus of a printing device according to a preferred embodiment of the present invention.

As shown in FIG. 2, the paper feeding apparatus includes a tray 200 combined with the main frame 100 of the printing device, for receiving paper, a guide plate 210 movable along a rail 201 formed in the tray 200, according to the page size of the paper received in the tray 200, and a page size sensing means for sensing the movement position of the guide plate 210 and for determining the page size of the paper received in the tray 200 from the position information.

The page size sensing means includes a link 220 pivotally installed around a hinge shaft 223 provided in the tray 200, a rack 230 which is connected to the link 220 and slides, a driving plate 240 which rotates, engaged with the rack 230, and a sensor 300 for detecting a mark provided in the driving plate 240 and sensing the page size of the paper.

First and second slots 221 and 222 are formed at both ends of the link 220. The guide plate 210 is combined with the first slot 221. The rack 230 is combined with the second slot 222. Therefore, when the guide plate 210 moves, the link 220 pivots. Accordingly, the rack 230 is interlocked to the guide plate 210 and slides. The hinge shaft 223 slants more to the rack 230 than to the guide plate 210 and is located in the link 220. Therefore, the distance the to rack 230 moves is shorter than the distance the guide plate 210 moves. With such a structure, it is possible to effectively reduce the occupied space required for moving the rack 230 in the tray 200. Namely, it is possible to reduce the occupied space by reducing the distance the rack 230 is required to move for sensing the page size of paper compared to displacement of the guide plate 210.

Figure 3:
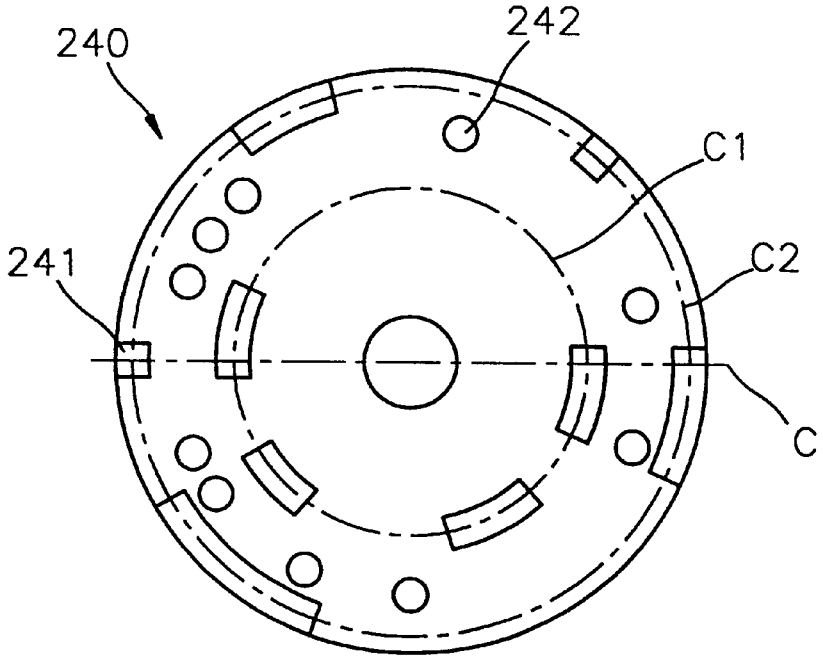
FIG. 3 shows a driving plate of the paper feeding apparatus shown in FIG. 2.
Figure 4:
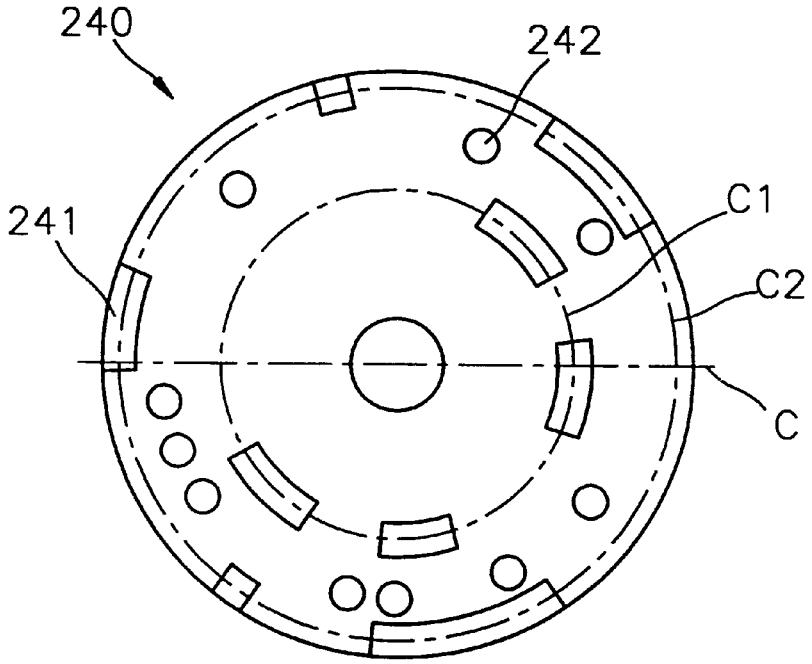
FIG. 4 shows a driving plate of the paper feeding apparatus shown in FIG. 2.

The driving plate 240 rotatably supported on one side wall of the tray 200 is engaged with the rack 230. A plurality of marks are formed at predetermined positions of the driving plate 240. The marks are preferably protrusions 241. The protrusions 241 are respectively formed at predetermined positions along a first circle C1 and a second circle C2 of the driving plate 240 as shown in FIG. 3. Therefore, when the driving plate 240 rotates, the combination of the protrusions 241 arranged on a horizontal line C passing through the center of the driving plate 240 varies. For example, in FIG. 3, four protrusions 241 are arranged on the horizontal line C as viewed from the left to right side of the drawing. When the driving plate 240 is rotated about 60° in a counterclockwise direction, the protrusions 241 are arranged on a horizontal line C in first and third positions as viewed from the left to the right side of the drawing as shown in FIG. 4. The page size of the paper corresponds to the arrangement of the protrusions 241 and thus, the corresponding page size of the paper is sensed by the sensor 300.

To do this, four on/off sensors S1, S2, S3, and S4 are arranged across a sensor board 310 so as to be vertically parallel to each other in the main body 100 as shown in FIG. 2. The positions where the on/off sensors S1, S2, S3, and S4 are arranged is as high as the horizontal line C of the driving plate 240. The driving plate 240 and the sensor board 310 are installed such that the protrusions 241 face the on/off sensors S1, S2, S3, and S4. A plate spring 320 is installed on the on/off sensor S1, S2, S3, and S4. Therefore, the on/off sensors S1, S2, S3, and S4 are pressed when the protrusions 241 press the respective plate spring 320. Such a structure prevents damage to the on/off sensors S1, S2, S3, and S4 due to a severe shock generated by the protrusions 241 directly touching the on/off sensors S1, S2, S3, and S4 when the tray is loaded into the main body 100 of the printing device. Table 1 shows examples of the page size of the paper according to the number of cases where the on/off sensors S1, S2, S3, and S4 are pressed.

TABLE 1

| | Page size | | Amount of | Angle of rotation of | State where on/off |
|---|---|---|---|---|---|
| Number | Name | Size (mm) | movement of rack (mm) | driving plate (°) | sensor is turned on |
| 1 | LEDGER | 432* 279 | 0 (reference position) | 0 (reference position) | S1, S2, S3, and S4 |
| 2 | A3 | 420* 297 | 6.0 | 22.9 | S2, S3, and S4 |
| 3 | B4 | 364* 257 | 34.0 | 129.9 | S1, S3, and S4 |
| 4 | Legal | 356* 216 | 38.0 | 145.1 | S3 and S4 |
| 5 | FOLIO | 330* 216 | 51.5 | 194.8 | S1, S2, and S3 |
| 6 | A4 (Rotated) | 297* 210 | 67.5 | 257.8 | S2 and S4 |
| 7 | Letter (Rotated) | 279* 216 | 76.5 | 292.2 | S1 |
| 8 | Letter | 216* 279 | 108.0 | 412.5 | S3 |
| 9 | A4 | 210* 297 | 111.0 | 424.0 | S1 and S3 |
| 10 | Executive | 184* 268 | 124.0 | 473.6 | S4 |

Here, the hinge shaft 223 of the link 220 is provided at a position where the ratio of the length of the guide plate 210 to that of the rack 230 is 2:1. The driving plate 240 rotates in a counterclockwise direction. Namely, the distance the rack 230 moves is half the distance the guide plate 210 moves.

Referring to Table 1, when the four sensors S1, S2, S3, and S4 are turned on by controlling the position of the guide plate 210, it means that paper of "Ledger size" is received. When only the sensors S1 and S3 are turned on, it means that paper of "A4 size" is received.

Reference numeral 301 denotes a position guide pin for guiding a correct position of the driving plate 240 relative to the sensor board 310. Specifically, the guide pin 301 is inserted into a guide hole 242 formed on the driving plate 240 when the tray 200 is combined with the main body 100 of the printing device.

In the above structure, when the paper A4 is to be received and used, after the tray 200 is pulled out from the main body 100 of the printing device, the position of the guide plate 210 is controlled to meet the page size requirement. Then, the rack 230 connected to the link 220 moves 111 mm from the reference position as indicated by number 9 of Table 1. Also, the driving plate 240 is rotated 424° (360°+64°) from the reference position, thus forming the state of FIG. 4. In this state, when the paper is loaded and the tray 200 is pushed in the main body 100 of the printing device, the protrusions 241 arranged in the first and third positions from the left side press the plate spring 320 and operate the on/off sensors S1 and S3. When the sensors S1 and S3 operate, a controller 400 loaded in the main body 100 of the printing device senses that paper of A4 size is loaded into the tray 200 as set in Table 1 and displays a message indicating that paper of A4 size is loaded in the tray 200 on an LCD screen (not shown) installed in the main body 100 of the printing device so as to inform the user.

When paper of A3 and A4 size is used, the guide plate 210 is controlled to meet the page size requirement of the paper, and the tray 200 is combined with the main body 100 of the printing device, the protrusions 241 whose positions are controlled by the rotation of the driving plate 240, selectively press and operate the sensors S1, S2, S3, and S4, thus, generating signals corresponding to the respective page sizes of the paper.

Therefore, when the tray 200 is combined with the main body 100 and after controlling the guide plate according to the page size of the paper to be used, the signal indicating the page size is generated. Accordingly, the user can check the page size of the paper currently in the tray 200 without having to pull the tray out of the main body.

As mentioned above, according to the paper feeding apparatus of the printing device according to the present invention, since it is possible to check the page size of the received paper even in a state where the tray is inserted into the printer main body, it is possible to prevent print errors from occurring due to the size of the image to be printed not corresponding to the page size of the paper.

What is claimed is:

1. A paper feeding apparatus of a printing device comprising a tray releasably combined to a main body of the printing device for receiving paper, a guide plate movably installed in the tray according to the page size of the paper, and a page size sensing means for sensing the movement position of the guide plate and determining the page size of the paper received in the tray, wherein the page size sensing means comprises:

a link which is pivotally installed centering around a hinge shaft provided in the tray, to one end of which the guide plate is connected, and which pivots around the hinge shaft according to the movement of the guide plate;

a rack slidably installed in the tray, connected to the other end of the link, and sliding according to the pivot of the link;

a driving plate which rotates, engaged with the rack and in which a plurality of marks corresponding to the page size of the paper are formed; and a sensor for sensing the marks and the page size of the paper.

2. The paper feeding apparatus of claim 1, wherein the hinge shaft is arranged to slant more to the rack than to the guide plate so that the distance the rack interlocked to the guide plate moves is shorter than the distance the guide plate moves.

3. The paper feeding apparatus of claim 1, wherein the marks are a plurality of protrusions formed on the driving plate;

the sensor comprises a plurality of on/off sensors which selectively contact the plurality of protrusions according to the rotation of the driving plate; and the page size of the paper is determined by a combination of the plurality of on/off sensors selectively contacted.

* * * * *